US005924313A

United States Patent [19]

Kuo

[11] Patent Number: 5,924,313

[45] Date of Patent: Jul. 20, 1999

[54] COMBINATION LOCK WITH A DEVICE FOR CHANGING THE COMBINATION

[76] Inventor: Lambert Kuo, No. 16, Lane 459, Sec. 1, An Ho Rd, Tainan, Taiwan

[21] Appl. No.: 09/150,057

[22] Filed: Sep. 9, 1998

[51] Int. Cl.[6] ..... E05B 37/02

[52] U.S. Cl. ..... 70/26; 70/312

[58] Field of Search ..... 70/21–30, 52, 70/233, 311, 312, 321, 322, 326–328

[56] References Cited

U.S. PATENT DOCUMENTS

| | | | |
|---|---|---|---|
| 546,969 | 9/1895 | Bozano | 70/29 |
| 556,573 | 3/1896 | Bozano | 70/29 |
| 877,682 | 1/1908 | Turman | 70/28 |
| 970,856 | 9/1910 | Simisky | 70/29 |
| 1,034,263 | 7/1912 | Lorey | 70/28 |
| 1,117,417 | 11/1914 | Meepos | 70/29 |
| 1,146,443 | 7/1915 | Pellegrino | 70/28 |
| 1,205,781 | 11/1916 | Piróg | 70/28 |
| 5,406,811 | 4/1995 | Nakai | 70/30 X |
| 5,560,232 | 10/1996 | Chen | 70/30 |
| 5,787,736 | 8/1998 | Ling | 70/312 X |
| 5,791,169 | 8/1998 | Kuo | 70/26 |
| 5,850,751 | 12/1998 | Kuo | 70/26 |

*Primary Examiner*—Lloyd A. Gall
*Attorney, Agent, or Firm*—Holland & Hart LLP

[57] ABSTRACT

A lock with a combination selecting mechanism for releasing is constructed by a U-shaped shackle and a locking bar. A combination selecting mechanism is provided in the locking bar. The lock can be released by selecting the correct number series on the tumblers. A combination change control mechanism is further provided in the combination selecting mechanism, so that the combination can not be reset when the combination change control mechanism is in effect, thereby it is possible to avoid an undesired combination change.

13 Claims, 7 Drawing Sheets

COMBINATION LOCK WITH A DEVICE FOR CHANGING THE COMBINATION

BACKGROUND OF THE INVENTION

1. Field of the Invention

The present invention relates to a lock with a device for changing the combination thereof, and more particularly to a lock which prevents the combination thereof from being changed by mistake.

2. Description of Related Art

A conventional lock is constructed to have a U-shaped shackle and a locking bar. The locking bar provides a means to operate the combination, so that the shackle can be released from the locking bar without a key. The combination can be reset when the lock is open. Thereby, the user will usually turn the tumbler to reset the number by mistake. With the new and likely unknown combination, the lock will not be able to be opened with the original combination.

The present invention provides an improved lock to mitigate and/or obviate the aforementioned problems.

SUMMARY OF THE INVENTION

The main object of the present invention is to provide a lock with a means of changing the combination which will not be changed by mistake.

Other objects, advantages and novel features of the invention will become more apparent from the following detailed description when taken in conjunction with the accompanying drawings.

DETAILED DESCRIPTION OF THE PREFERRED EMBODIMENT

Figure 1:
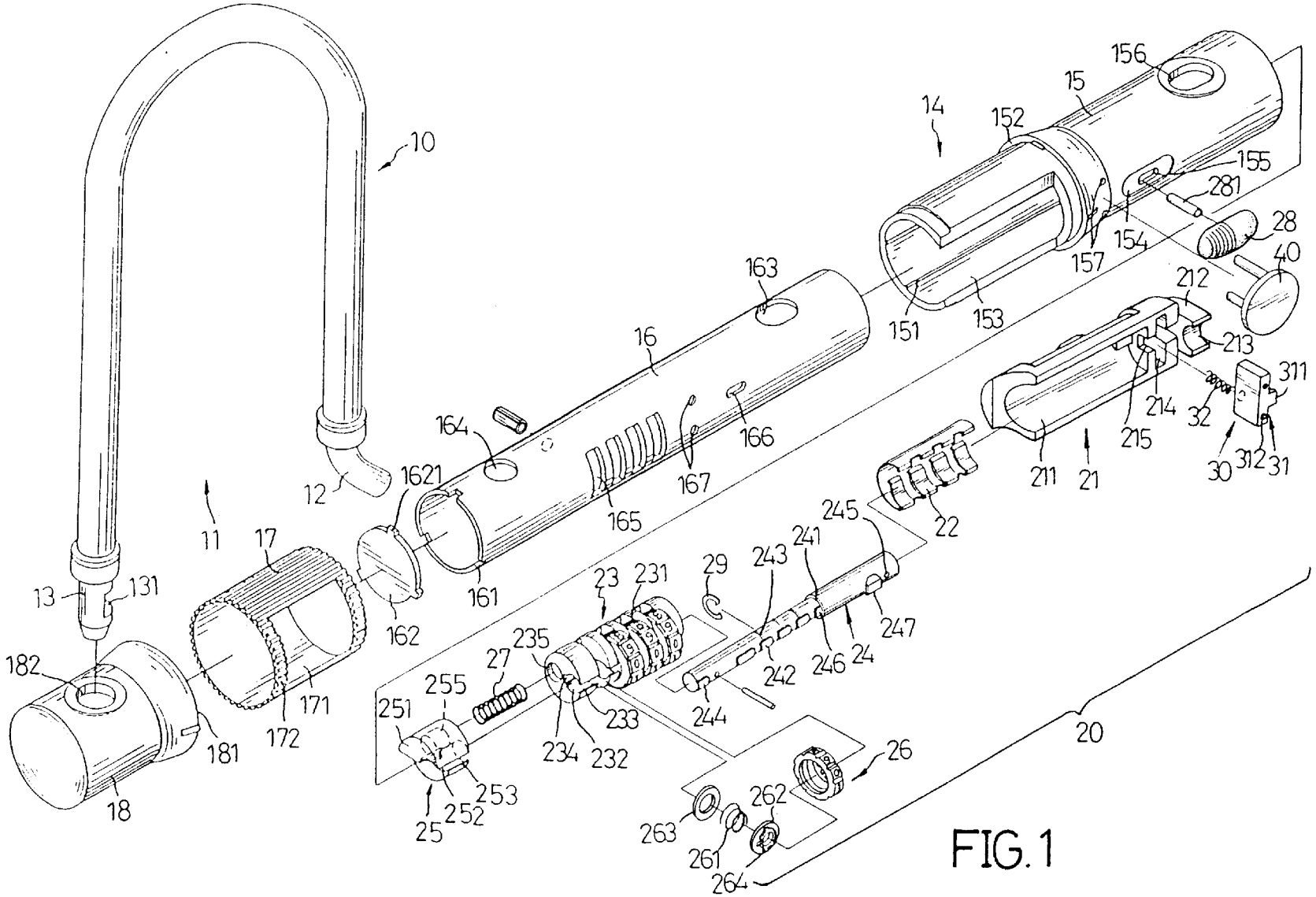
FIG. 1 is an exploded view of a lock of the present invention.

Referring to FIG. 1, a lock constructed in accordance with the present invention comprises a U-shaped shackle (10) and a locking bar (14).

The U-shaped shackle (10) has a first distal end (13) and a second distal end (12). The first distal end (13) defines a notch (131) on the inside thereof.

The locking bar (14) has a casing (15), an inner tube (16) received in the casing (15), a combination selecting means (20) disposed in the inner tube (16), a sleeve (17) partially covering the casing (16) and a cap (18) mounted on the distal end of the casing (15). The detailed description of the above-mentioned construction is made hereinafter.

Figure 2:
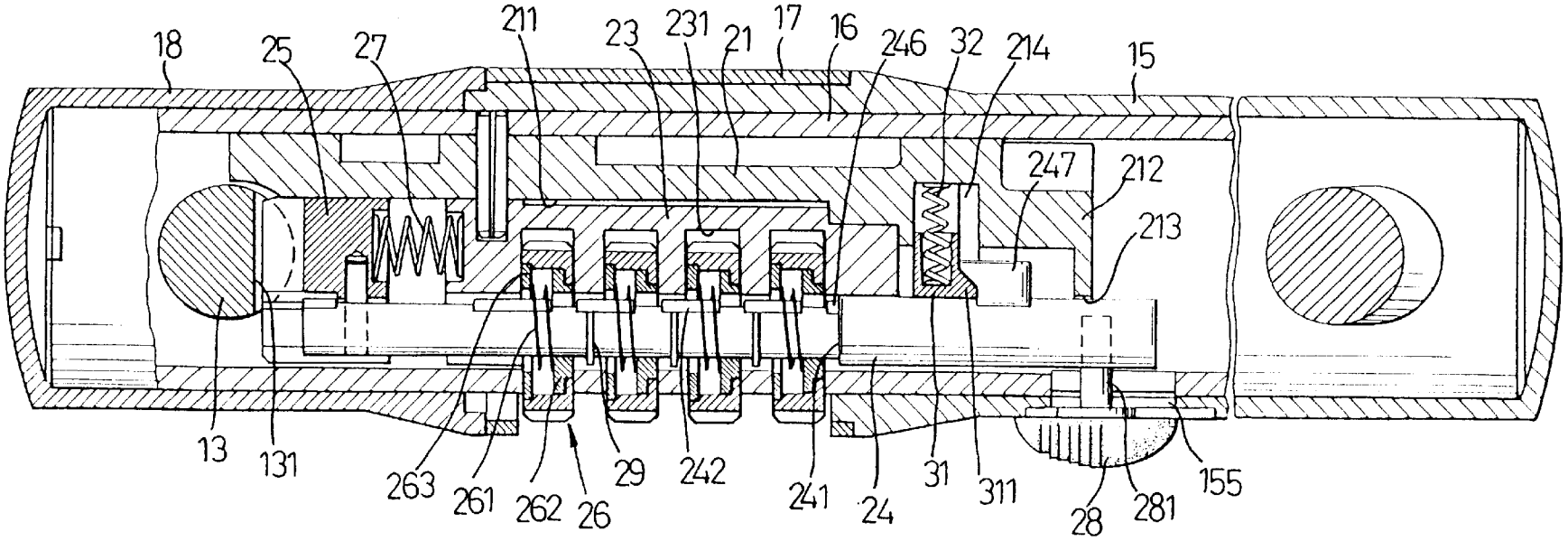
FIG. 2 is a sectional top view of the lock of the present invention.
Figure 3:
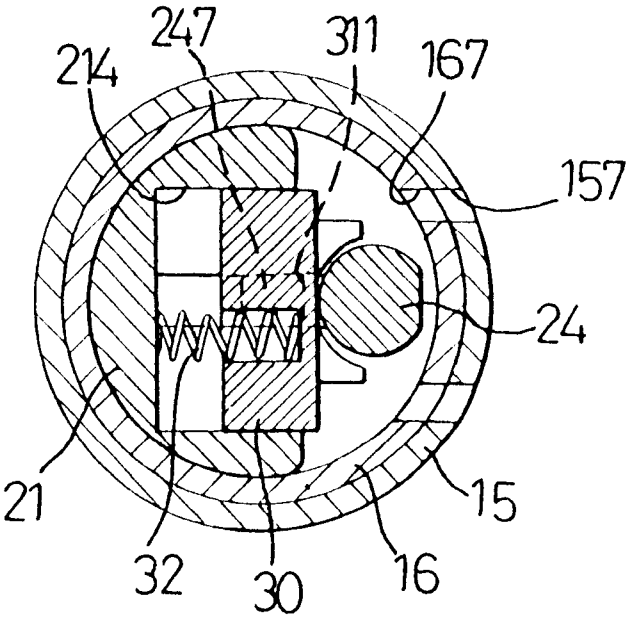
FIG. 3 is an end view showing the combination change control means of the present invention.

As illustrated in FIGS. 1 and 2, the casing (15), of which one end thereof is closed, has a cutout (153) defined at the open end (151) thereof. A shoulder (152) is formed in the middle portion of the casing (15) with two outer apertures (157) defined through the shoulder (152). A recess (154) is defined in the periphery of the casing (15) and an outer slot (155) is defined in the face defining the recess (154). A first outer lock hole (156) for receiving the second distal end (12) of the shackle (10) is defined in the periphery of the casing (15).

The inner tube (16) respectively defines two inner lock holes (163, 164) in the periphery of both ends thereof. The inner lock hole (163) corresponds to the first outer lock hole (156) of the casing (15) and the inner lock hole (164) corresponds to a second outer lock hole (182). Two inner apertures (167) and an inner slot (166) respectively corresponding to the outer apertures (157) and the outer slot (155) are defined in the periphery of the inner tube (16). The inner tube (16) further defines a plurality of tumbler slots (165) in the periphery thereof. A plurality of notches (161) are defined in a distal end of the inner tube (16). A cover (162) having a plurality of protrusions (1621) each corresponding to one of the notches (161) is provided for engaging with the distal end of the inner tube (16).

The sleeve (17) forms knurls (172) thereon for the convenience of rotation by a user and defines a window (171) aligned with the tumbler slots (165) of the inner tube (16).

The cap (18) with the distal end closed, defines an opening (181) complementary to the open end (151) of the casing (15) and the second outer lock hole (182) defined in the periphery of the cap (18) is provided for receiving the first distal end (13) of the shackle (10).

The combination selecting means (20) received in the inner tube (16) has a semi-circular seat (21). The seat (21) defines a curved-channel (211) at an end thereof and forms a shaft support (212) at the other end thereof. The shaft support (212) has a curved-wall (213) formed therein. A transverse slot (214) and a longitudinal slot (215) are defined between the curved-channel (211) and the shaft support (212) and are in communication with each other.

A combination change control means (30) has a body (31) received in the transverse slot (214) and a locking member (311) received in the longitudinal slot (215). Two orifices (312) are defamed in the outer face of the body (31) and aligned with the outer apertures (157) and the inner apertures (167). A first spring (32) is disposed between the body (31) and the transverse slot (214). In the first preferred embodiment, the locking member (311) forms an inclined plane in the end thereof. In another embodiment, the locking member (311) may form a step in the end.

A core (23) is movably received within the curved-channel (211) of the seat (21) and positioned by a reed (22). The core (23) defines a plurality of transverse grooves (231) therein and a longitudinal hole (232) therethrough. Two guide channels (233, 234) are respectively defined on each side of the longitudinal hole (232). A cavity (235) is defined in a distal end face of the core (23).

Each of a plurality of tumblers (26) are rotatably positioned in the corresponding grooves (231) of the core (23) and partially exposed from the tumbler slots (165) of the inner tube (16) when installed therein. Each tumbler (26) receives therein a control ring (262) having a plurality of teeth (264) thereon, a second spring (261) and a collar (263) to fasten the control ring (262) and the first spring (261) therein.

A shaft (24) which is designed a stepped construction is provided through the longitudinal hole (232) of the core (23). An end of the shaft (24) is disposed in the curved-wall (213) of the shaft support (212) and a through aperture (245) is defined in the end. A stop (247) is formed on the shaft (24) and adjacent to the through aperture (245). In the first preferred embodiment, the stop (247) forms an inclined plane corresponding to the inclined plane of the locking member (311) of the combination change control means. In the other embodiment, the stop (247) forms a step corresponding to the step of the locking member (311). The shaft (24) provides a flange (241) formed thereon and a dome (246) formed on the flange (241). A plurality of lugs (242) are formed on the middle portion of the shaft (24) and spaced apart to correspond to the grooves (231) in the core (23). A plurality of semi-circular grooves (243) are peripherally defined on the shaft (24) each corresponding to one of the lugs (242). A C-clip (29) is received in each of the semi-circular grooves (243). A protrusion (244) is formed on another end of the shaft (24).

The locking catch (25) detachably engaged with the end forming the protrusion (244) of the shaft (24) is provided. The locking catch (25) forms an extension (251) detachably received in the notch (131) to lock the U-shaped shackle (10). The locking catch (25) defines a longitudinal channel (252) therethrough for receiving the shaft (24) and a chute (253) at the outside of the channel (252) and in communication therewith. A blind hole (255) is defined in the end abutting the core (23) and aligned with the cavity (235). A third spring (27) is received in the blind hole (255) and the cavity (235).

A button (28) is movably mounted on the recess (154) and connected with the shaft (24) by a pin (281) inserted through the outer slot (155) of the casing (15), the inner slot (166) of the inner tube (16) and the through aperture (245) of the shaft (24). Moving the button (28) can drive the shaft (24).

During assembly, the shaft (24) is firstly inserted through the longitudinal hole (232) of the core (23) and the longitudinal channel (252) of the locking catch (25) with the lugs (242) and the protrusion (244) facing outside toward the guiding channel (233). When the protrusion (244) extends beyond the chute (253), the shaft (24) is then turned 180° and pulled towards the locking catch (25) to have the protrusion (244) securely against the end face of the catch (25).

Figure 4:
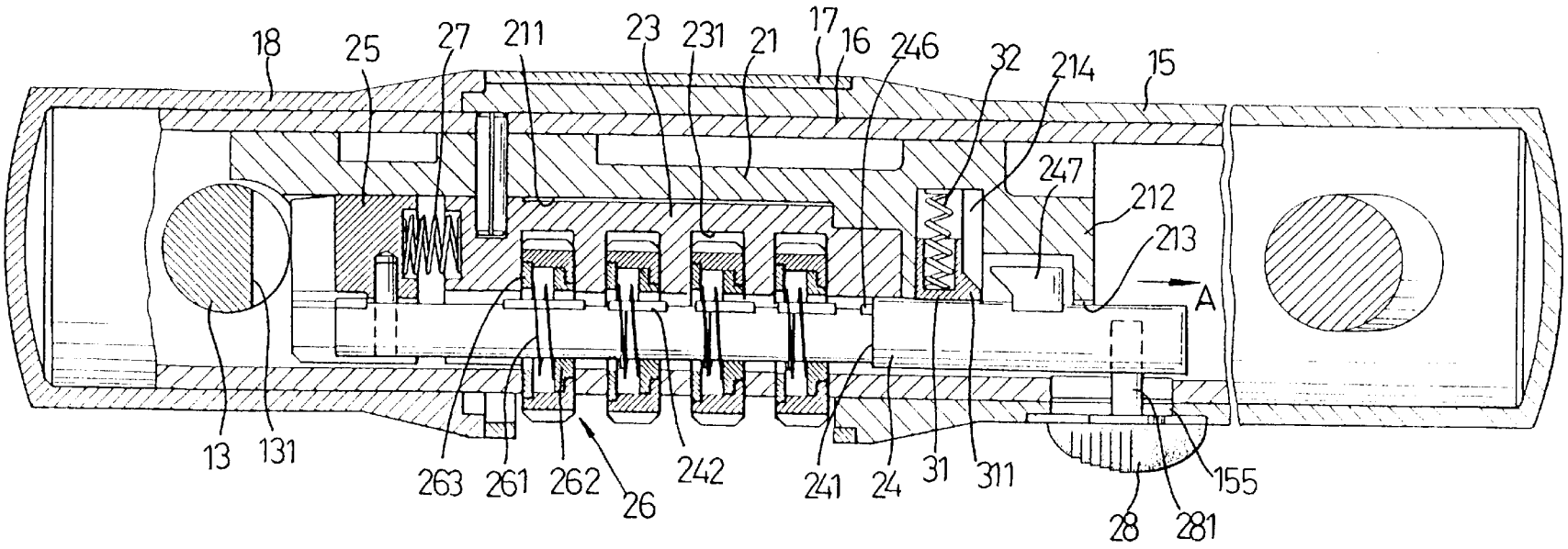
FIG. 4 is a sectional top view showing the lock being opened.

When the correct series of numbers is selected on the tumblers (26), the shaft (24) can be moved towards the proximal end, as shown by the arrow A in FIG. 4. Therefore, the locking catch (25) will release the notch (131) to unlock the first distal end (13), so that the shackle (10) can be released from the locked state.

Figure 6:
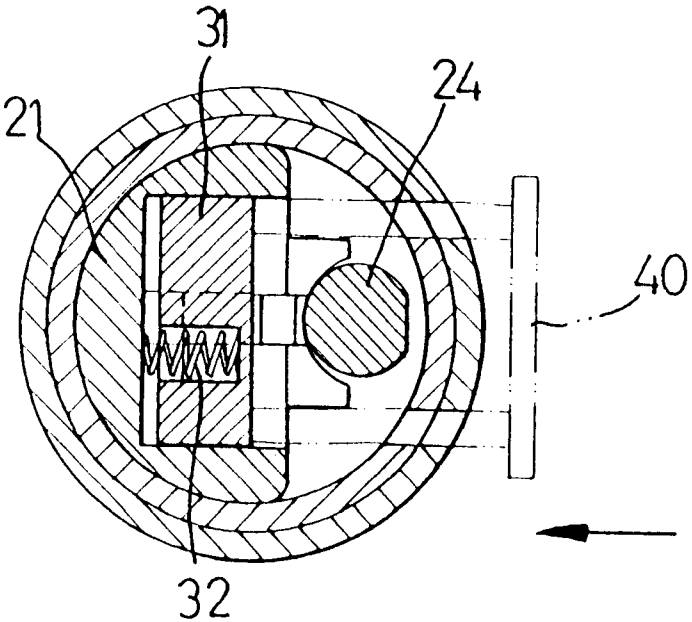
FIG. 6 is an end view showing the combination change control means being pushed inward to allow changing the combination.
Figure 5:
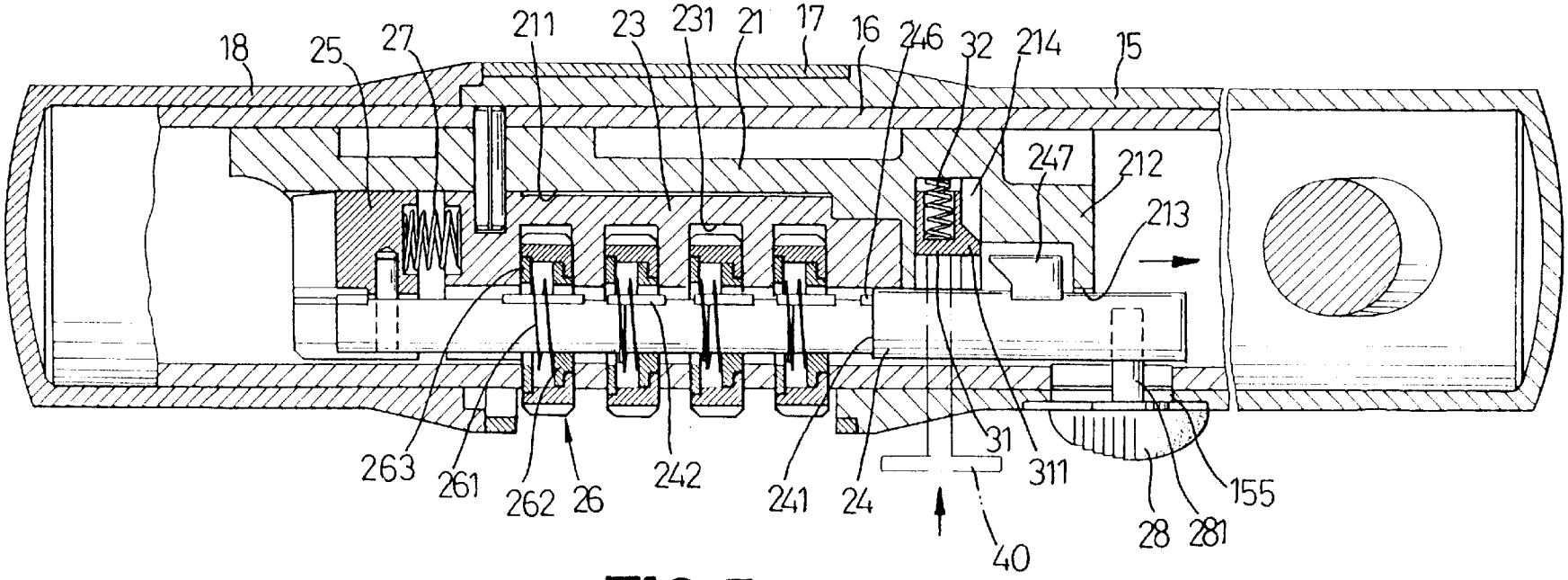
FIG. 5 is a sectional view showing the combination change control means being pushed to allow changing the combination thereof.
Figure 7:
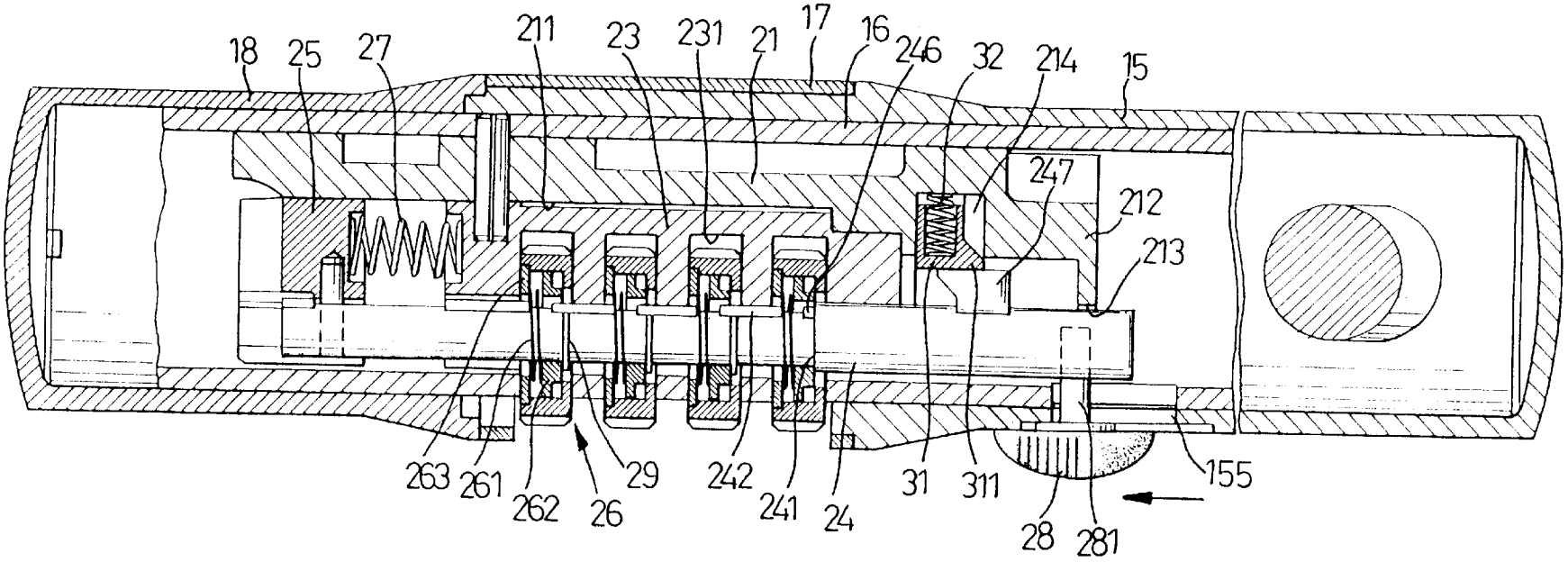
FIG. 7 is a sectional view showing the shaft being moved beyond the combination change control means to allow changing the combination.
Figure 9:
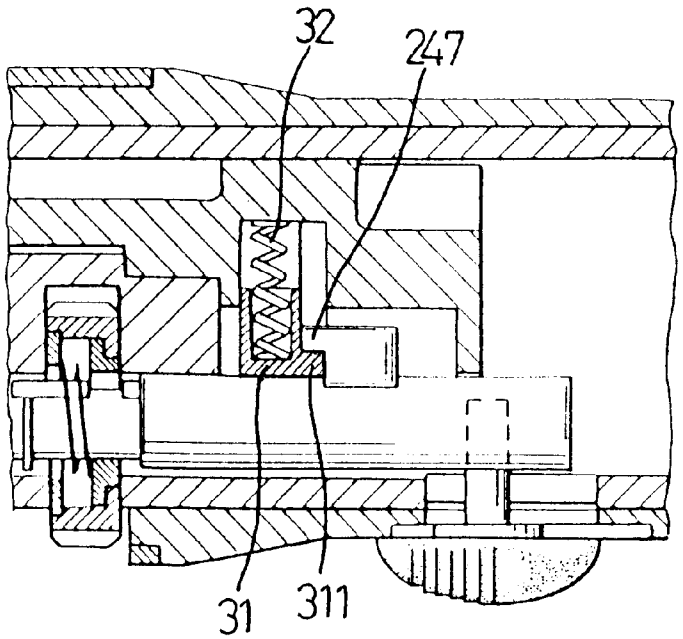
FIG. 9 is a partial sectional view of another preferred embodiment of the combination change control means of the present invention.
Figure 8:
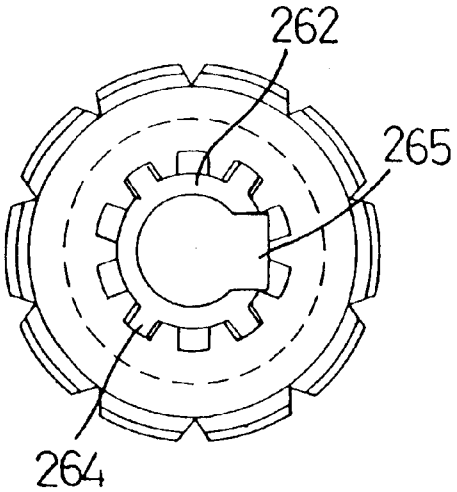
FIG. 8 is an enlarged view of the tumbler of the present invention.

In this case, the numerals of the tumblers (26) can not be reset because the combination change control means (30) holds the stop (247) of the shaft (24) by the design of mutually corresponding inclined planes or steps. When a user intends to change the combination on the tumblers (26), he or she has to insert an actuator (40) through the outer apertures (157), the inner apertures (167) and the orifices (312) to push the combination change control means (30) inward to disengage the stop (247) and the locking member (311), as shown in FIG. 5 and 6. Then, the shaft (24) can be moved, so that the control rings (262) are separated from the tumblers (26) by the dome (246) and the C-clips (29). Thereby, the user can reset the combination numbers on the tumblers (26). After the operation is accomplished, the shaft (24) is moved to the original position, and the combination change control means is mated with the stop (247) again.

The advantages of the present invention are:

1. It is impossible to reset the number of the tumblers when a user does not want to, because the combination change control means holds the stop of the shaft to avoid the control rings from separating from the tumblers.
2. It is also impossible to reset the numbers on the tumblers when the tumblers are selected to an incorrect combination, because the shaft can not be moved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combination lock with a device for changing the combination thereof comprising:

a U-shaped shackle having a first distal end and a second distal end, the first distal end defining a notch on the side opposite the second distal end; and a locking bar comprising a casing having a closed end, an open end provided with a cutout defined therein; a shoulder formed in a middle portion thereof; two outer apertures defined through the shoulder; a recess defined in the periphery thereof; an outer slot defined in a face defining the recess and communicating therewith; and a first outer lock hole defined in the periphery near the closed end for receiving the second distal end of the U-shaped shackle;

an inner tube partially received in the casing and having two inner lock holes respectively defined in the periphery of both ends thereof; a plurality of notches defined in a distal end thereof; a cover having a plurality of protrusions each corresponding to one of the notches and securely engaged on the distal end; a plurality of tumbler slots defined on a periphery thereof; two inner apertures corresponding to the outer apertures defined in the periphery of the casing; and an inner slot corresponding to the outer slot defined on the periphery of the casing;

a combination selecting means received in the inner tube and having a semi-circular seat having a curved-channel defined at an end thereof, a shaft support formed at the other end, a transverse slot and a longitudinal slot respectively defined between the curved-channel and the shaft support and in communication with each other, a combination change control means received in the seat;

a core mounted within the curved-channel of the seat and having a plurality of grooves defined therein, a longitudinal hole therethrough, and a guiding channel on each side of the longitudinal hole;

a plurality of tumblers respectively and rotatably received in the grooves of the core and exposed out from the tumbler slots of the inner tube, each having a control ring, a collar and a spring received therebetween to fasten the control ring;

a shaft inserted through the longitudinal hole and having a through aperture defined in an end disposed in the shaft support, a stop formed adjacent to the through aperture to detachably engage the combination change control means, a flange formed thereon, a dome formed on the flange, a plurality of lugs corresponding to the grooves formed thereon and a protrusion formed on the other end;

a locking catch engaged with the shaft and having an extension detachably received in the notch of the shackle, a longitudinal channel defined therethrough for receiving the shaft and a chute defined at the outside of the channel;

a button movably mounted on the recess of the casing and connected with the shaft via a pin inserted through the outer slot, the inner slot and the through aperture of the shaft;

a sleeve partially covering the inner tube and defining a window corresponding to the tumbler slots of the inner tube; and a cap having a closed end and defining an opening corresponding to the open end of the casing and a second outer lock hole in the periphery for receiving the first distal end of the shackle.

2. The lock as claimed in claim 1, wherein the combination change control means has a body movably received in the transverse slot of the seat and a locking member movably received in the longitudinal slot and detachably connected with the stop of the shaft.

3. The lock as claimed in claim 2, wherein the body defines two orifices corresponding to the inner and outer apertures.

4. The lock as claimed in claim 1, wherein a first spring is provided between the combination change control means and the seat.

5. The lock as claimed in claim 2, wherein the locking member of the combination change control means forms an inclined plane and the stop of the shaft also forms a corresponding inclined plane.

6. The lock as claimed in claim 2, wherein the locking member of the combination change control means forms a step and the stop of the shaft also forms a corresponding step.

7. The lock as claimed in claim 1, wherein the combination selecting means has a reed provided to position the core in the seat.

8. The lock as claimed in claim 1, the combination selecting means further has a plurality of teeth and defines a slot therein.

9. The lock as claimed in claim 1, wherein a spring is located between the combination change control means and the collar.

10. The lock as claimed in claim 1, wherein a plurality of semi-circular grooves are defined in the side opposite to the lugs of the shaft and a corresponding number of C-clips are received in the semi-circular grooves.

11. The lock as claimed in claim 1, wherein the core defines a cavity in an end facing the locking catch and the locking catch defines a blind hole aligned with and corresponding to the cavity.

12. The lock as claimed in claim 11, wherein a spring is located between the cavity and the blind hole.

13. The lock as claimed in claim 1, wherein the sleeve forms a plurality of knurls thereon.

* * * * *